US009427997B2

(12) United States Patent
Nishikawa

(10) Patent No.: US 9,427,997 B2
(45) Date of Patent: Aug. 30, 2016

(54) DATA PROCESSING APPARATUS, PRINTING APPARATUS, AND DATA PROCESSING METHOD

(71) Applicant: CANON KABUSHIKI KAISHA, Tokyo (JP)

(72) Inventor: Yukinori Nishikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/006,502

(22) Filed: Jan. 26, 2016

(65) Prior Publication Data

US 2016/0221373 A1 Aug. 4, 2016

(30) Foreign Application Priority Data

Feb. 4, 2015 (JP) ..... 2015-020417

(51) Int. Cl.
*B41J 29/38* (2006.01)

(52) U.S. Cl.
CPC ..... *B41J 29/38* (2013.01)

(58) Field of Classification Search
CPC ..... B41J 2/2132; B41J 29/38; B41J 2/2054; B41J 2/2056; G06K 15/102; G06K 15/107; H04N 1/4057
See application file for complete search history.

(56) References Cited

U.S. PATENT DOCUMENTS 7,267,415 B2 * 9/2007 Saruta ..... G06K 15/102 19/86

FOREIGN PATENT DOCUMENTS

JP 2010-143026 7/2010

* cited by examiner

*Primary Examiner* — Thinh Nguyen
(74) *Attorney, Agent, or Firm* — Fitzpatrick, Cella, Harper & Scinto

(57) ABSTRACT

There is provided a data processing apparatus, a printing apparatus and a data processing method, that can reduce a processing load and a processing time in reading data even in a case where null data is added to print data for correcting displacement of a printing position caused by inclination of a print head. To achieve this, there is provided a data processing apparatus including a first writing unit, a second writing unit and a reading unit. The reading unit reads out data arrays corresponding to the print target image and does not read out data arrays corresponding to outside of the print target image in the first storage unit, from a plurality data arrays stored in the second storage unit that have been written in by the second written in unit.

18 Claims, 17 Drawing Sheets

DATA PROCESSING APPARATUS, PRINTING APPARATUS, AND DATA PROCESSING METHOD

BACKGROUND OF THE INVENTION

1. Field of the Invention

The present invention relates to a data processing apparatus that generates a signal used for reading print data from a predetermined storage unit, a printing apparatus, and a data processing method.

2. Description of the Related Art

In a printing apparatus using a print head having a printing element array consisting of printing elements, the head may be mounted in a manner inclined relative to a reference position because of, for example, a manufacturing error in manufacturing a head or a mounting error in mounting a head to an apparatus. To reduce displacement of a printing position caused by the inclination of the head, there is known a method in which null data that is irrelevant to printing of an image is added to a portion corresponding to a print start position and a portion corresponding to a print end position in print data, and the resulting data is stored in a storage unit. In this method, in reading data from the storage unit to transmit print data to the head, all data including the null data is read. This places a relatively heavy processing load and causes its processing time to be relatively longer.

To prevent this, Japanese Patent Laid-Open No. 2010-143026 discloses a printing apparatus configured to read, from a storage unit, print data divided into predetermined units, add null data to the divided print data, and transmit the resulting data to the head such that the displacement of a printing position caused by inclination of a head is corrected.

In the printing apparatus of Japanese Patent Laid-Open No. 2010-143026, however, providing a dedicated circuit for the processing of combining the data as divided and the null data may make the circuit complicated and increase a cost of the apparatus as a whole. Therefore, it is preferable to reduce a processing load and a processing time without providing the dedicated circuit.

SUMMARY OF THE INVENTION

The present invention has been made to solve the above-described problems. An object of the present invention is to provide a data processing apparatus capable of reducing a processing load and a processing time in reading data even in a case where null data is added to print data for correcting displacement of a printing position, a printing apparatus, and a data processing method.

According to a first aspect of the present invention, there is provided a data processing apparatus comprising: a first writing unit configured to write a plurality of printing data arrays corresponding to a print target image to be printed by a print heads having ink ejecting port array into a first storage unit and write a predetermined data arrays representing not printing into area corresponding to outside of the print target image in the first storage unit; a second writing unit configured to read out data included the plurality of printing data arrays and the predetermined data arrays that have been written into the first storage unit by the first writing unit and write the read out data into a second storage unit with shifting in a direction perpendicular to the arraying direction of the plurality of printing data arrays and the predetermined data arrays according to an inclination of the print head; and a reading unit configured to read out the data that have been written in the second storage unit by the second writing unit, for each data array corresponding to a predetermined ejecting timing of the ink ejecting port array, wherein the reading unit reads out data arrays corresponding to the print target image and does not read out data arrays corresponding to outside of the print target image in the first storage unit, from a plurality data arrays stored in the second storage unit that have been written in by the second written in unit.

According to a second aspect of the present invention, there is provided a printing apparatus comprising: a first writing unit configured to write a plurality of printing data arrays corresponding to a print target image to be printed by a print head having ink ejecting port array into a first storage unit and write a predetermined data arrays representing not printing into area corresponding to outside of the print target image in the first storage unit; a second writing unit configured to read out data included the plurality of printing data arrays and the predetermined data arrays that have been written into the first storage unit by the first writing unit and write the read out data into a second storage unit with shifting in a direction perpendicular to the arraying direction of the plurality of printing data arrays and the predetermined data arrays according to an inclination of the print head; a reading unit configured to read out the data that have been written in the second storage unit by the second writing unit, for each data array corresponding to a predetermined ejecting timing of the ink ejecting port array, and a control unit configured to control the print head according to the data that is read out by the reading unit, wherein the reading unit reads out data arrays corresponding to the print target image and does not read out data arrays corresponding to outside of the print target image in the first storage unit, from a plurality data arrays stored in the second storage unit that have been written in by the second written in unit.

According to a third aspect of the present invention, there is provided a data processing method comprising: a first writing step for writing a plurality of printing data arrays corresponding to a print target image to be printed by a print heads having ink ejecting port array into a first storage unit and writing a predetermined data arrays representing not printing into area corresponding to outside of the print target image in the first storage unit; a second writing step for reading out data included the plurality of printing data arrays and the predetermined data arrays that have been written into the first storage unit by the first writing step and writing the read out data into a second storage unit with shifting in a direction perpendicular to the arraying direction of the plurality of printing data arrays and the predetermined data arrays according to an inclination of the print head; and a reading step for reading out the data that have been written in the second storage unit by the second writing step, for each data array corresponding to a predetermined ejecting timing of the ink ejecting port array, wherein the reading step reads out data arrays corresponding to the print target image and does not read out data arrays corresponding to outside of the print target image in the first storage unit, from a plurality data arrays stored in the second storage unit that have been written in by the second writing step.

Further features of the present invention will become apparent from the following description of exemplary embodiments (with reference to the attached drawings).

DESCRIPTION OF THE EMBODIMENTS

With reference to the drawings, an embodiment of the present invention will be described.

Embodiment

Figure 1:
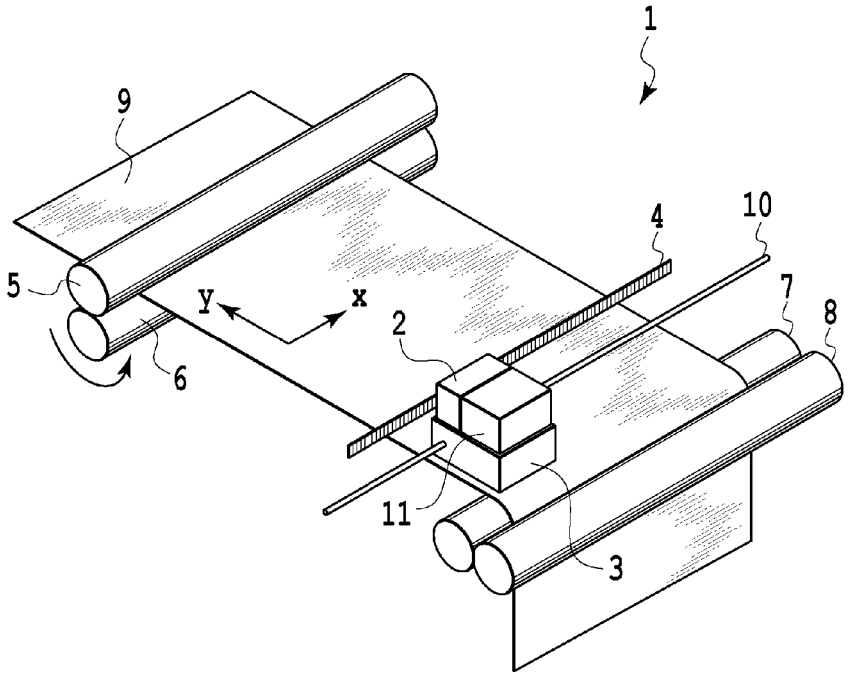
FIG. 1 is a schematic perspective view showing an internal configuration of an ink jet printing apparatus.

FIG. 1 is a schematic perspective view showing an internal configuration of an ink jet printing apparatus (hereinafter referred to as a "printing apparatus") 1 according to the present embodiment. As shown in FIG. 1, the printing A apparatus 1 has an ink cartridge 11, a head cartridge (print head) 2, a carriage 3, a guide shaft 10, an encoder scale 4, and rollers 5 to 8. The ink cartridge 11 separately stores four colors of inks, black (Bk), cyan (C), magenta (M), and yellow (Y), as liquid. The ink stored in the ink cartridge 11 is supplied to the head cartridge 2. On a surface of the head cartridge 2 facing a print medium 9, an ejection port array including ejection ports for ejecting ink is provided. Although not shown in FIG. 1, a plurality of ejection ports are formed in y direction shown in FIG. 1, and the plurality of ejection ports form the ejection port array. The head cartridge 2 is provided with eight ejection port arrays, and one color of ink is ejected from the ejection ports of two ejection port arrays. Each ejection port array includes 320 ejection ports. Although not shown, a heater, which is a heating resistor, is used in this example as an energy generating element (printing element) that generates energy for ejecting ink from the ejection port. The heater is provided in a manner corresponding to the ejection port.

The ink cartridge 11 and the head cartridge 2 are detachably mounted on the carriage 3. The carriage 3 slidably engages with the guide shaft 10 extending in x direction shown in FIG. 1 and reciprocates in the x direction. Further, the encoder scale 4 that extends in the x direction is provided parallel to the guide shaft 10 and at a position facing the carriage 3. The encoder scale 4 is provided with slits at intervals of 150 lpi. The carriage 3 has an encoder sensor (not shown) mounted thereon. The encoder scale 4 is irradiated with light emitted from a light emitting part (not shown) of the encoder sensor, the transmitted light is received at a light receiving part (not shown) and converted into an electric signal, and a signal relating to a scanning position of the carriage 3 is outputted.

On an upstream side and a downstream side of a direction in which the print medium 9 is conveyed (y direction shown in FIG. 1), a feed roller pair consisting of rollers 7 and 8 and a conveying roller pair consisting of rollers 5 and 6 are provided, respectively. The feed roller pair rotates while holding the print medium 9 between the rollers 7 and 8 to feed the print medium 9. The conveying roller pair rotates while holding the print medium 9 between the rollers 5 and 6 to convey the print medium 9. The rollers 6 and 7 are driven by a motor (not shown) to rotate. The roller 5 is driven and rotated by the rotation of the roller 6, and the roller 8 is driven and rotated by the rotation of the roller 7.

The printing apparatus 1 prints an image on the print medium 9 by a printing operation that ejects ink from the ejection ports of the print head 2 to the print medium 9 with movement of the carriage 3 in the x direction and a conveying operation that conveys the print medium 9 by the rollers.

Figure 2:
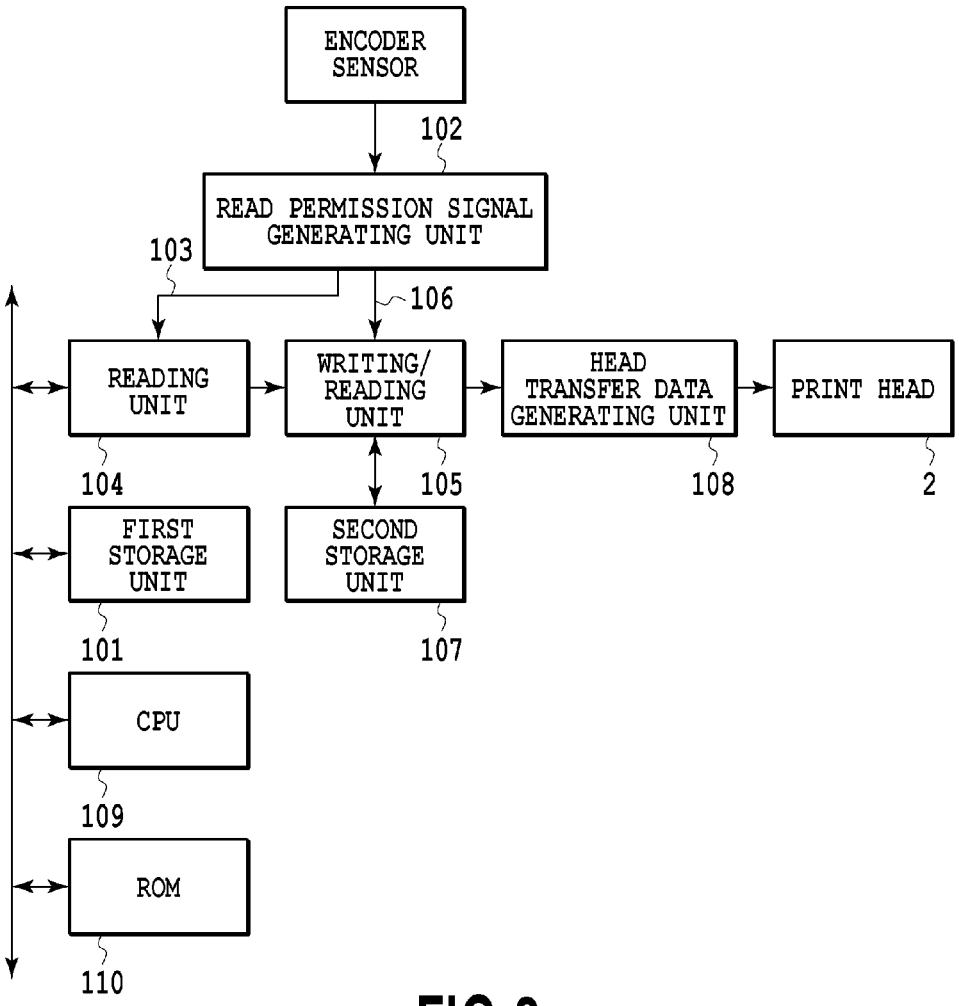
FIG. 2 is a block diagram showing a control configuration of the ink jet printing apparatus.

FIG. 2 is a block diagram showing a control configuration of the printing apparatus 1. As shown in FIG. 2, the printing apparatus 1 has a CPU (control unit, determination unit) 109, a first storage unit 101, a second storage unit 107, a read permission signal generating unit 102, a reading unit 104, a writing/reading unit 105, a head transfer data generating unit 108, and a ROM 110. The ROM 110 stores various programs and the like. The CPU 109 controls the printing apparatus 1 according to the programs stored in the ROM 110. The CPU 109 performs various settings for the read permission signal generating unit 102, the reading unit 104, the writing/reading unit 105, and the head transfer data generating unit 108.

The first storage unit 101 stores therein print data corresponding to each ink color. In the present embodiment, print data obtained by performing predetermined processing on image data is inputted to the printing apparatus 1 from an external apparatus, and the print data is stored in the first storage unit 101. It should be noted that in this example, a description will be given of the case where the print data after the predetermined processing is performed is inputted to the printing apparatus 1, but the image data may be inputted to the printing apparatus 1 and various kinds of processing may be performed on the image data in the printing apparatus 1 to generate print data corresponding to an ink color.

The read permission signal generating unit 102 specifies a position of the carriage 3 based on an output from the encoder sensor and outputs each signal according to the specified position. More specifically, based on positional information on the carriage 3, the read permission signal generating unit 102 outputs a first read permission signal 103 to the reading unit 104 and outputs a second read permission signal 106 to the writing/reading unit 105.

The first read permission signal 103 is a signal indicating a timing at which the reading unit 104 reads print data from the first storage unit 101. The second read permission signal 106 is a signal indicating a timing at which the writing/reading unit 105 reads print data from the second storage unit 107.

The reading unit 104 reads the print data from the first storage unit 101 in response to the first read permission signal 103 and transmits it to the writing/reading unit 105. The writing/reading unit 105 writes the print data received from the reading unit 104 to the second storage unit 107. The second storage unit 107 temporarily stores the print data read from the first storage unit 101. Further, the writing/reading unit 105 reads again the print data temporarily stored in the second storage unit 107 in response to the second read permission signal 106 and transmits it to the head transfer data generating unit 108. The head transfer data generating unit 108 converts the received print data to a data transfer format compatible with the print head and transfers it to the print head 2. The heater is driven based on the transferred print data, so that ink is ejected from the ejection ports of the print head 2.

Figure 3:
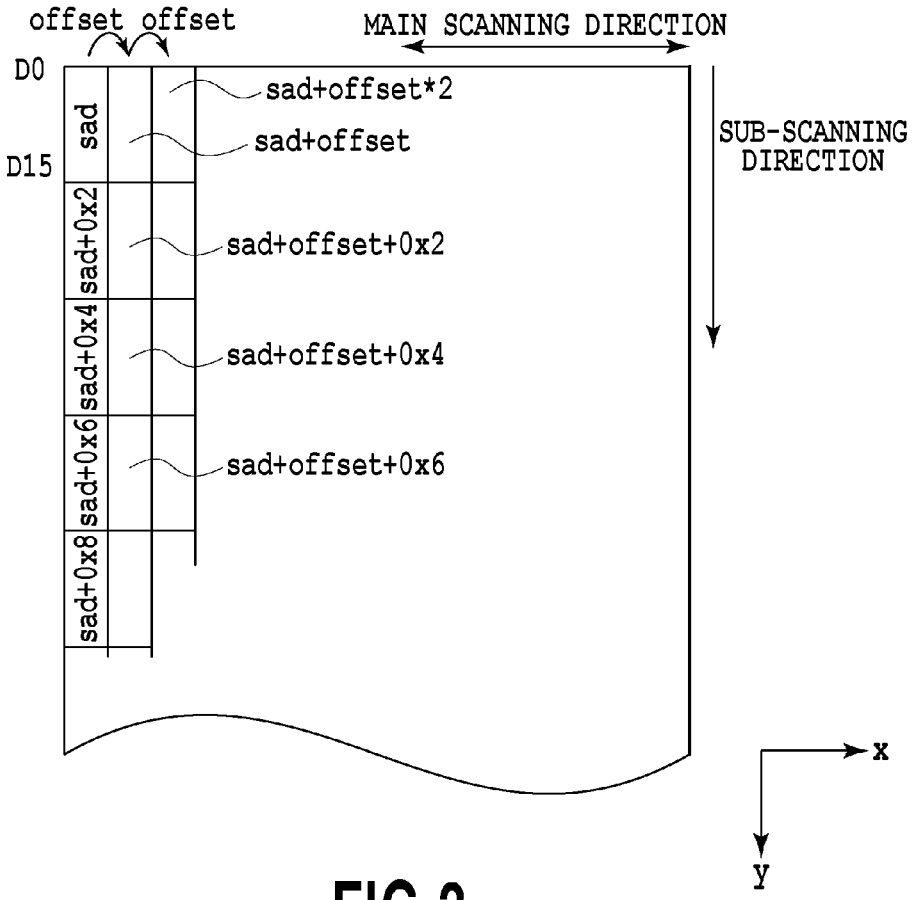
FIG. 3 is a view showing a storage format of print data in a first storage unit.

FIG. 3 is a view showing a storage format of print data in the first storage unit 101 and representing the storage format of the print data assigned to an ejection port array as an image on the print medium. In a portion of a frame shown in FIG. 3, there is shown an address in the first storage unit 101 that stores print data on the image to be printed. As shown in FIG. 3, the print data printed on the upper left portion of the print medium 9 is stored in address sad (sad is any variable) in the first storage unit 101. The print data on the image to be printed on the left portion of the print medium 9 is stored in successive addresses, sad+0x2, sad+0x4 . . . in the y direction, namely, a direction in which the ejection ports forming an ejection port array are arranged. Further, print data on the portion separated by n columns in the x direction from the print data to be printed on the upper left portion of the print medium 9 is stored in address sad+offset(sad is any variable)×n. With respect to other ejection port arrays, print data is stored in their respective different areas in the same format as the format shown in FIG. 3.

Figure 4:
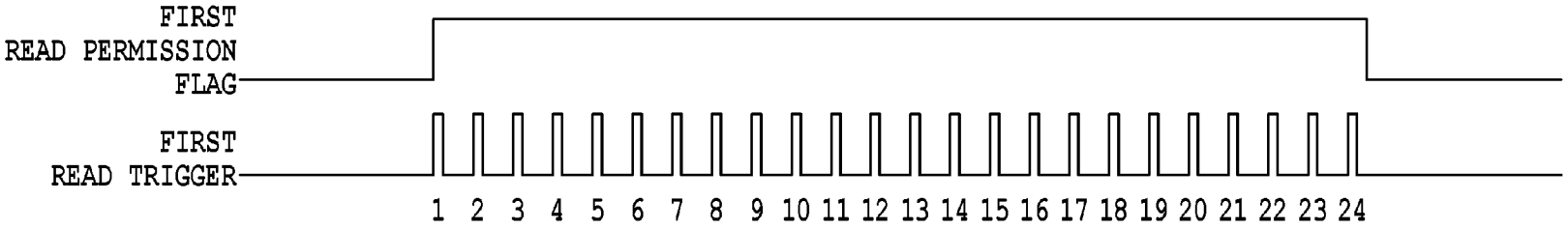
FIG. 4 is a view showing a first read permission signal.

FIG. 4 is a view showing details of the first read permission signal 103. As shown in FIG. 4, the first read permission signal 103 includes a first read permission flag and a first read trigger. The first read permission signal 103 is generated for each ejection port array. The first read trigger is a pulse signal. If it is determined that the carriage 3 has reached a predetermined position based on a signal inputted from the encoder sensor, the read permission signal generating unit 102 allows the first read permission flag to transit to a high level ("H") indicating an active state. Also, the read permission signal generating unit 102 allows the first read trigger to transit to "H" indicating an active state at intervals that print data corresponding to one column is printed on the print medium.

In a case where an output of the first read trigger becomes "H" while the first read permission flag is "H," the reading unit 104 reads print data corresponding to one column from the first storage unit 101. The reading unit 104 transmits the read print data to the writing/reading unit 105. The writing/reading unit 105 stores the received print data in the second storage unit 107. The above processing is completed by the time when the first read trigger becomes "H" next time. In the case shown in FIG. 4, while the first read permission flag is "H," the first read trigger becomes "H" 24 times, so print data corresponding to 24 columns is read from the first storage unit 101. The number of times the first read trigger becomes "H" while the first read permission flag is "H" is appropriately set in the first read permission signal generating unit 102.

In this example, the amount of print data corresponding to one column read through the reading processing at a time by the reading unit 104 from the area in which the print data assigned to the predetermined ejection port array is stored depends on the number of ejection ports of the ejection port array. A description will be given of the case where printing is started from the upper left portion of the print medium 9 shown in FIG. 1*n* a case where 320 ejection ports form each ejection port array as the present embodiment. If an output of the first read trigger 1 becomes "H" for a first time while the first read permission flag is "H," the reading unit 104 successively reads print data of 320 bits in total from the areas from address "sad" to address "sad+0x26" in the first storage unit 101. If the first read trigger becomes "H" for a second time while the first read permission flag is "H," the reading unit 104 successively reads print data from the areas from address "sad+offset" to address "sad+offset+0x26" in the first storage unit 101. Then, every time an output of the first read trigger becomes the "H" level while the first read permission flag is "H," the reading unit 104 reads in succession print data from the areas with addresses to which offset is added.

Figure 5:
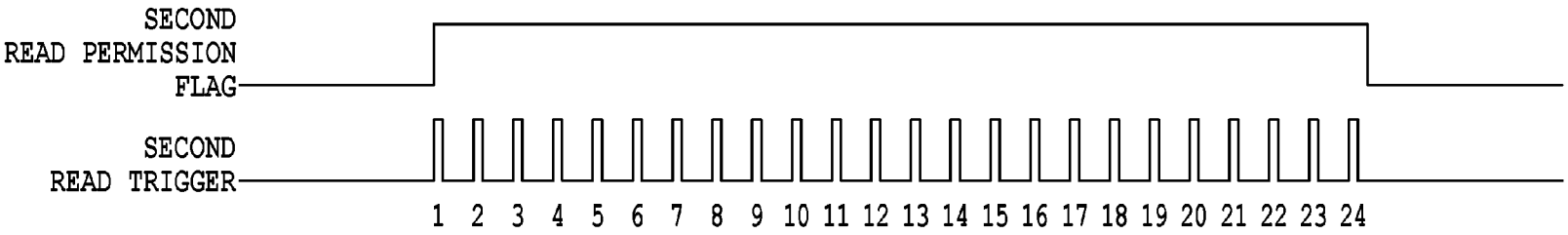
FIG. 5 is a view showing a second read permission signal.

FIG. 5 is a view showing details of the second read permission signal 106. As shown in FIG. 5, the second read permission signal 106 includes a second read permission flag and a second read trigger. The second read permission signal 106 is generated for each ejection port array. In a case where an output of the second read trigger becomes "H" while the second read permission flag is "H," the writing/reading unit 105 reads print data corresponding to one column in an amount according to the number of ejection ports of the ejection port array from the second storage unit 107.

In the second storage unit 107, an area corresponding to 320×8 dots is prepared for each ejection port array of each color as a storage area of the print data, and the following address areas are assigned to the ejection port arrays. As described above, in this example, two ejection arrays are used to eject the same color of ink, so two address areas are assigned to each color.

Bk 0x000-0x13E, 0x140-0x27E
C 0x280-0x3BE, 0x3C0-0x4FE
M 0x500-0x63E, 0x640-0x77E
Y 0x780-0x8BE, 0x8C0-0x9FE

Regarding the area assigned to each ejection port array of each color, the height corresponds to the range in the y direction of each ejection port array. The width is set such that, in reading and writing the print data by the writing/reading unit 105, no new print data is written to an area in which unread print data is stored. Further, in a lateral direction, a ring configuration is employed.

Figure 6:
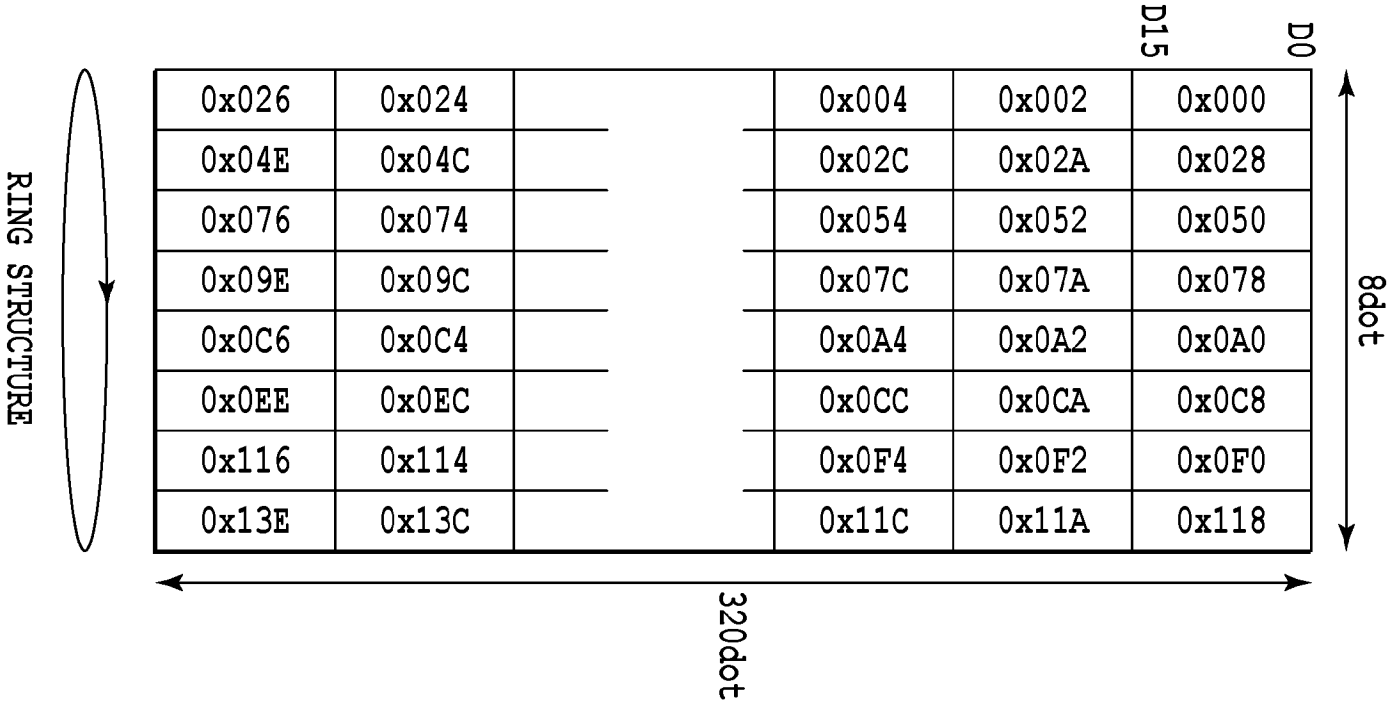
FIG. 6 is a view showing a storage format of print data in a second storage unit.

FIG. 6 is a view showing an example of a storage format of the print data corresponding to one of the two ejection port arrays ejecting a black ink in the second storage unit 107. As shown in FIG. 6, address area 0x000-0x13E is assigned to the ejection port array. The print data assigned to the ejection ports forming the ejection port array is read from the corresponding addresses. A description will be given of this ejection port array.

Figure 7:
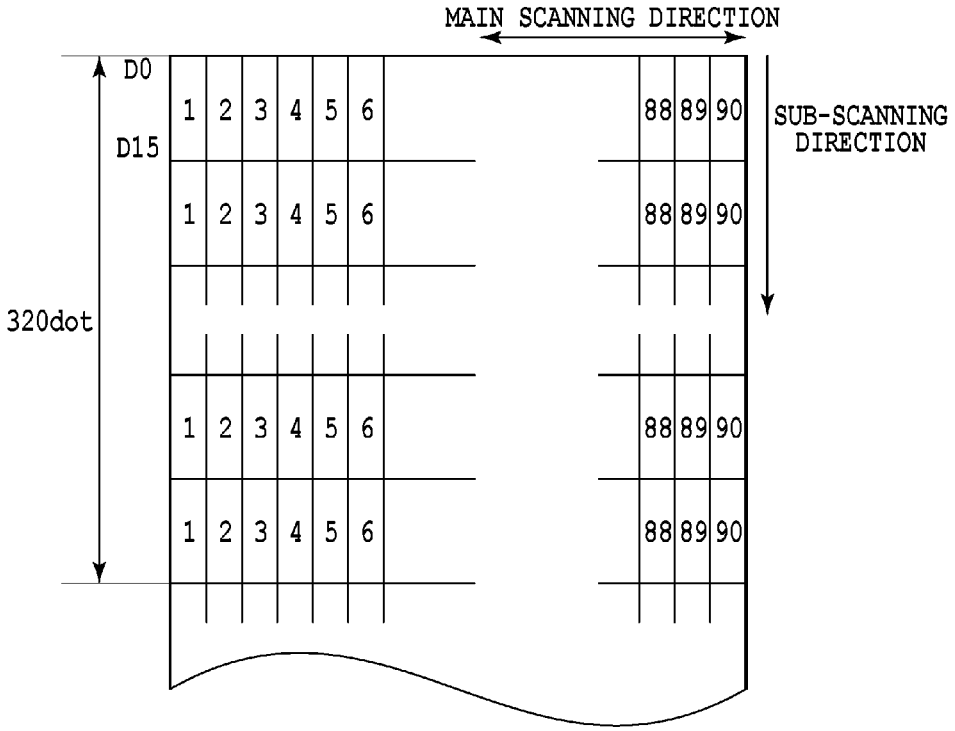
FIG. 7 is a view illustrating print data stored in the first storage unit.

FIG. 7 is a view illustrating print data stored in the first storage unit 101. In FIG. 7, like FIG. 3, a storage format of the print data assigned to an ejection port array is represented as an image on the print medium. FIG. 7 also shows that the same number is given to the frames in the same column. At a timing when the first read trigger becomes "H," the print data stored in the frames to which the same number is given is read. In this example, the print data corresponding to 90 columns in a main scanning direction is printed on the print medium 9.

Figure 8:
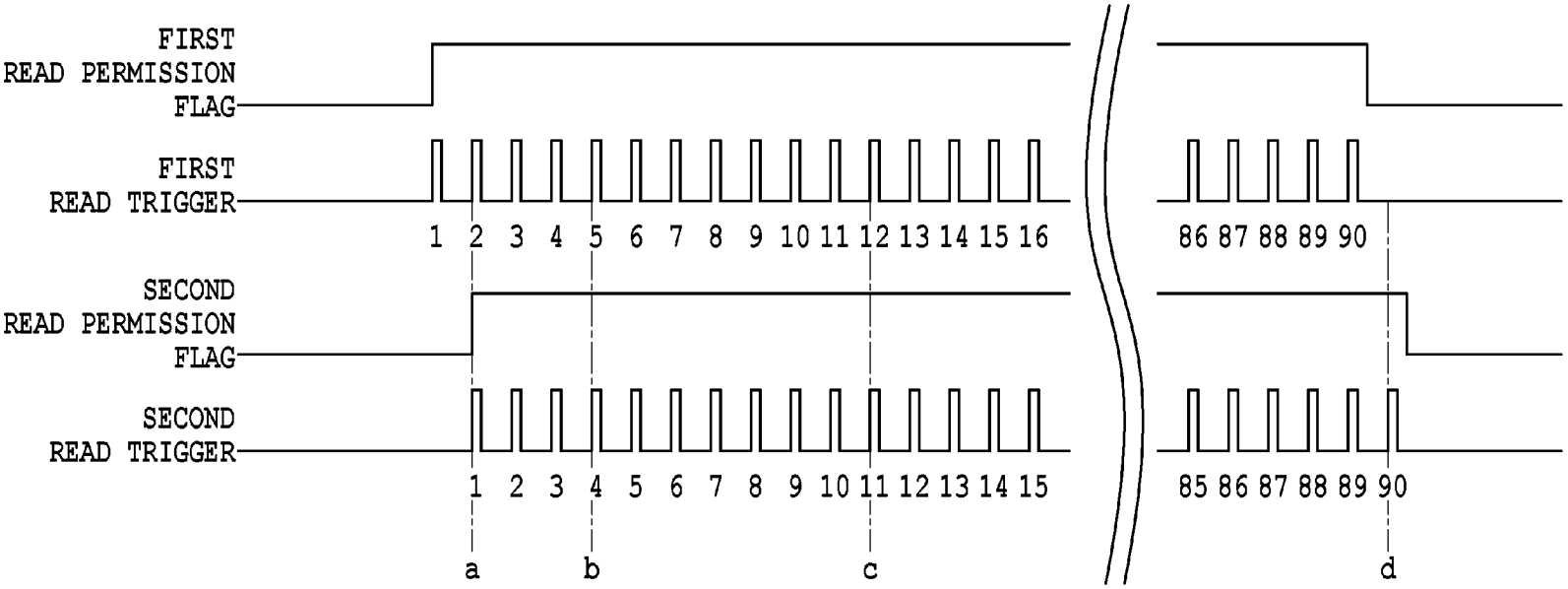
FIG. 8 is a view showing the first read permission signal and the second read permission signal.

FIG. 8 is a view showing the first read permission signal 103 and the second read permission signal 106 and illustrating a temporal relation between the two signals. To print the print data corresponding to 90 columns in the main scanning direction, the first read permission flag and the second read permission flag are "H" for a period of time during which the first read trigger and the second read trigger become "H" 90 times. As shown in FIG. 8, a timing at which the second read permission flag becomes "H" and the second read trigger becomes "H" for a first time corresponds to a timing at which the first read trigger becomes "H" for a second time. In other words, in one period of the first read trigger, the reading unit 104 reads the print data from the first storage unit 101 and transmits the print data to the writing/reading unit 105, and the writing/reading unit 105 completes writing of the print data to the second storage unit 107.

Figure 9A:
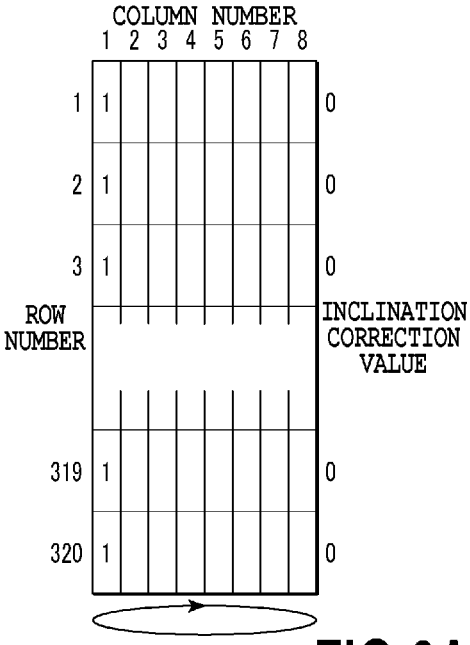
FIGS. 9A to 9D are views showing storage states of the print data in the second storage unit.
Figure 9B:
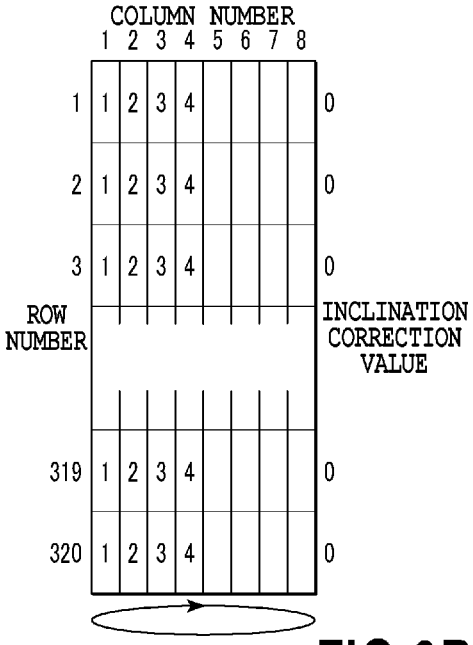

FIGS. 9A to 9D are views showing storage states of the print data in the second storage unit 107 at timings a to d shown in FIG. 8. FIG. 9A shows a storage state of the print data in the second storage unit 107 at a timing a, FIG. 9B at a timing b, FIG. 9C at a timing c, and FIG. 9D at a timing d. The numbers shown in the frames in FIGS. 9A to 9D correspond to the numbers shown in the frames shown in FIG. 7. More specifically, the print data stored in the frames to which the same number is given in FIGS. 9A to 9D represents that the print data has been stored in the same column shown in FIG. 7. In FIGS. 9A and 9B, in areas to which no number is added, undefined data is stored.

As shown in FIG. 9A, at the timing a as shown in FIG. 8, the print data in the first column in the first storage unit 101 is stored in the second storage unit 107. More specifically, in the areas with the column number 1 (addresses 0x000-0x026 shown in FIG. 6) in the second storage unit 107, the print data is stored. As shown in FIG. 8, since the second read trigger becomes "H" for the first time at the timing a, the writing/reading unit 105 starts reading of the print data stored in the areas with the column number 1 in the second storage unit 107.

As shown in FIG. 9B, at the timing b as shown in FIG. 8, the print data in the first to fourth columns in the first storage unit 101 is stored in the second storage unit 107. More specifically, in the areas with the column numbers 1 to 4 (addresses 0x000-0x026, 0x028-0x04E, 0x050-0x076, and 0x078-0x09E shown in FIG. 6) in the second storage unit 107, the print data is stored. As shown in FIG. 8, since the second read trigger becomes "H" for a fourth time at the timing b, the writing/reading unit 105 starts reading of the print data stored in the areas with the column number 4 in the second storage unit 107.

Figure 9C:
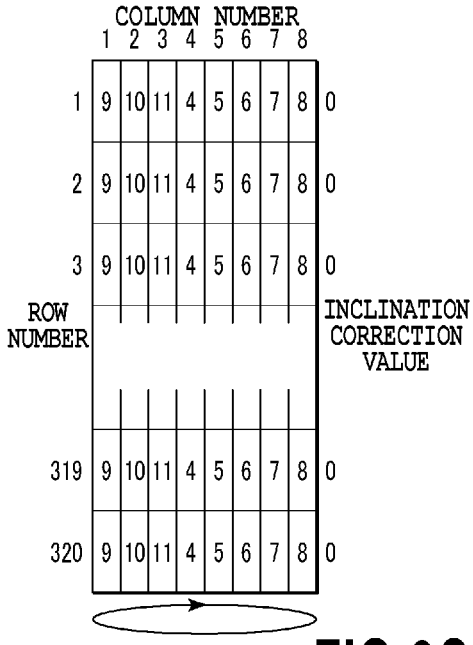

As shown in FIG. 9C, at the timing c as shown in FIG. 8, storing in the second storage unit 107 the print data to the eleventh column in the first storage unit 101 has been completed. The print data in the fourth to eighth columns in the first storage unit 101 is stored in the areas with the column numbers 4 to 8 in the second storage unit 107, respectively. Further, the print data in the ninth to eleventh columns in the first storage unit 101 is stored in the areas with the column numbers 1 to 3 in the second storage unit 107, respectively, because the lateral direction of the second storage unit 107 is a ring buffer. After the print data in the first to third columns is read out, the print data in the ninth to eleventh columns is overwritten. As shown in FIG. 8, since the second read trigger becomes "H" for an eleventh time at the timing c, reading of the print data stored in the areas with the column number 3 in the second storage unit 107 is started.

Figure 9D:
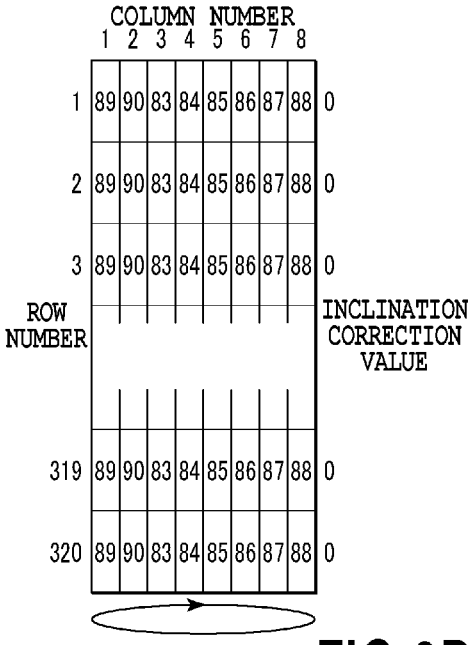

As shown in FIG. 9D, at the timing d as shown in FIG. 8, the print data in the 83rd to 90th columns in the first storage unit 101 is stored in the second storage unit 107. The print data in the 83rd to 88th columns in the first storage unit 101 is stored in the areas with the column numbers 3 to 8 in the second storage unit 107, respectively. The print data in the 89th and 90th columns in the first storage unit 101 is stored in the areas with the column numbers 1 and 2 in the second storage unit 107, respectively, because the lateral direction of the second storage unit 107 is a ring buffer. After the print data to the 82nd column is read, the print data in the 89th and 90th columns is overwritten. As shown in FIG. 8, since the second read trigger becomes "H" for a 90th time at the timing d, reading of the print data stored in the areas with the column number 2 in the second storage unit 107 is started.

As shown in FIG. 8, after the second read trigger becomes "H" for the 90th time and the writing/reading unit 105 finishes reading of the print data corresponding to 90 columns, the second read permission flag becomes a low level ("L"), entering a state in which reading is not permitted.

Figure 10:
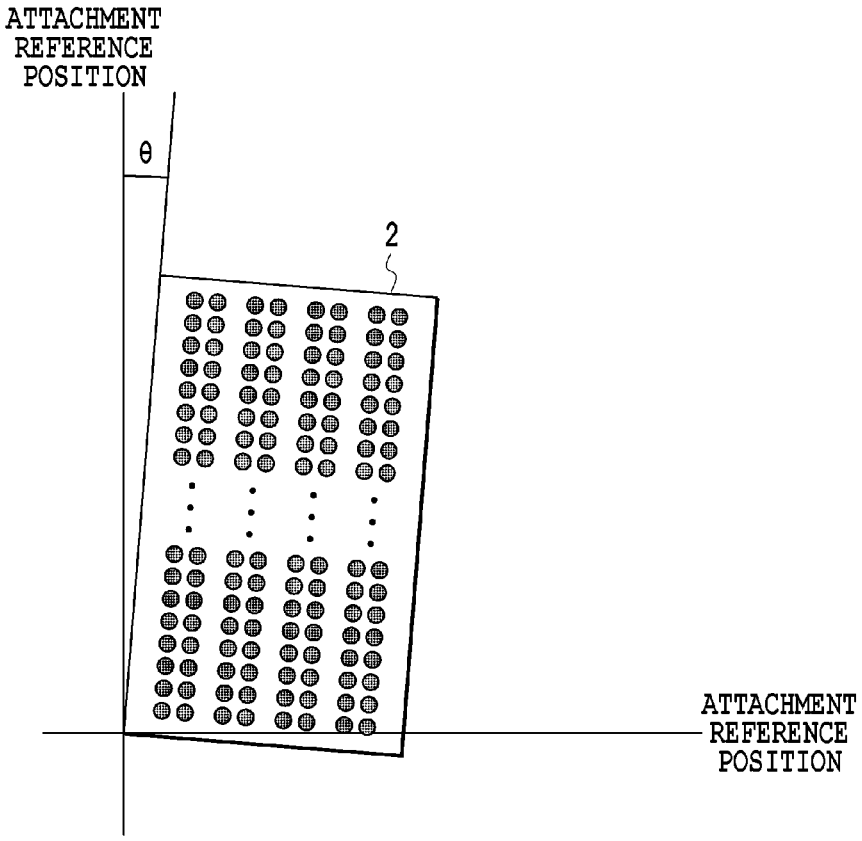
FIG. 10 is a schematic view showing an example of a print head mounted in a manner inclined relative to a reference position.

In the case where the print head is mounted on an attachment reference position, ejecting ink from the ejection ports according to the above process can apply ink to desired positions. As shown by an example in FIG. 10, however, in a case where the print head is mounted in a manner inclined relative to the attachment reference position, it is impossible to apply ink to desired positions even if the above process is performed to eject ink from the ejection ports. FIG. 10 is a schematic view showing an example of the print head 2 mounted in a manner inclined relative to the attachment reference position. As shown in FIG. 10, in a case where the print head is mounted in a manner inclined by an angle θ from the attachment reference position, if the above process is performed to eject ink from the ejection ports of the print head 2, ink is applied to the positions displaced by the angle θ from the desired positions depending on the positions of the ejection ports. In the present embodiment, therefore, to reduce printing position displacement generated in the case where the print head is mounted in a manner inclined, the print data is corrected. A correction value used for the correction is hereinafter also referred to as an inclination correction value.

With reference to FIG. 11 through FIGS. 17A to 17D, a description will be given of the case of correcting inclination by using the inclination correction value. Although details will be described later, it should be noted that, in this example, null data corresponding to the same number of columns as a maximum value of the inclination correction value is added to the left and right sides (a print start portion and a print end portion) of the print data stored in the first storage unit 101. The print data is read out for each column from the first storage unit 101 and diagonally written to the second storage unit 107 so as to compensate inclination of the print head according to the inclination correction value determined for each row. The written print data is read out for each column from the second storage unit 107. In this example, a period in which the second read permission flag is "H" is set shorter than a period in which the first read permission flag is "H" and the number of times the second read trigger becomes "H" is set less than the number of times the first read trigger becomes "H" so as not to perform reading processing on unnecessary data.

Figure 11:
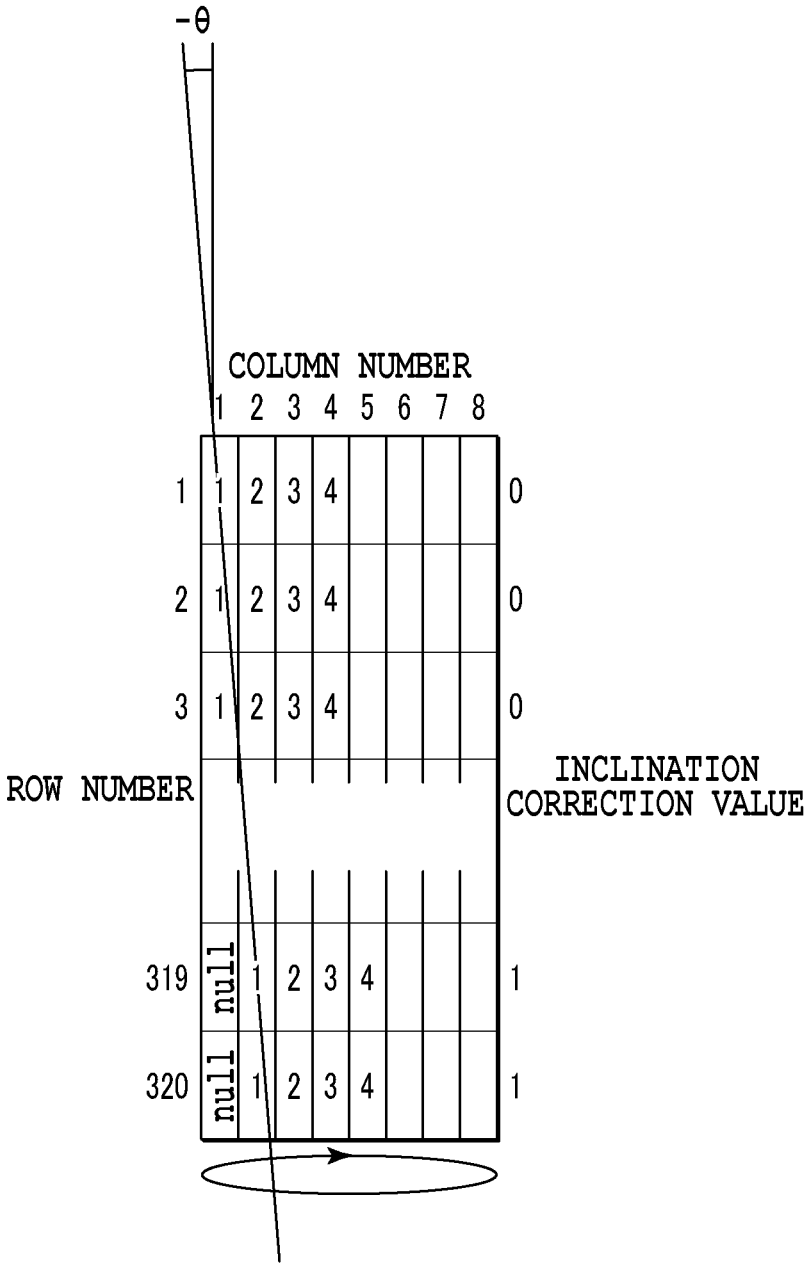
FIG. 11 is a view showing a storage state of the print data in the second storage unit.

FIG. 11 is a view showing a storage state of the print data in the second storage unit 107, and shows a storage state of the print data in a case where inclination (angle θ) is corrected in using the print head 2 shown in FIG. 10. The numbers given in the frames shown in FIG. 11 indicate the column numbers in the first storage unit 101. In this example, the print data stored in the same column in the first storage unit 101 is written to the second storage unit 107 so as to be stored with inclination by an angle of $-\theta$, that is, to compensate inclination of the print head. More specifically, according to the inclination correction value assigned to each row by the CPU 109, the writing/reading unit 105 writes the print data to the areas with the column number 1 through the areas with the column number shifted in the lateral direction by a predetermined amount from the column number 1. In reading out the print data from the second storage unit 107, the writing/reading unit 105 reads the print data of the same column number of the second storage unit 107. Then, based on the print data generated to reduce printing position displacement caused by the inclination of the print head, ink is ejected from the ejection ports. This can reduce the printing position displacement in the case where the print head is mounted in a manner inclined.

Figure 12A:
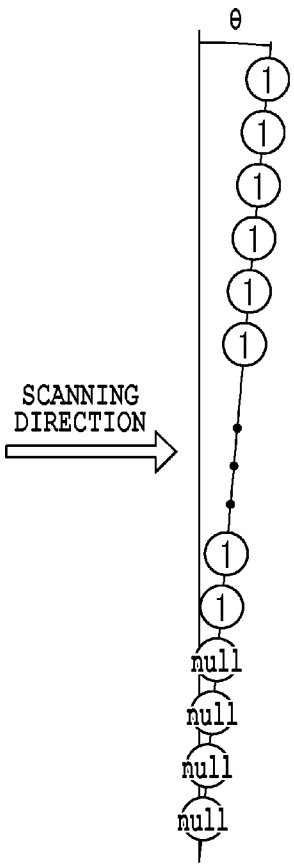
FIGS. 12A to 12C are schematic views showing printing positions in a case where inclination is corrected.
Figure 12B:
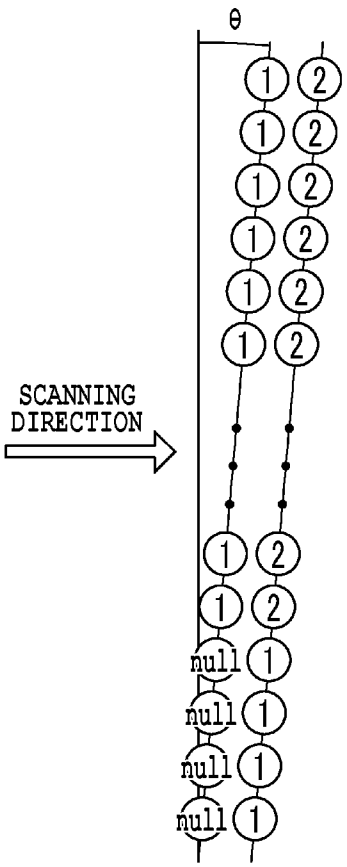
Figure 12C:
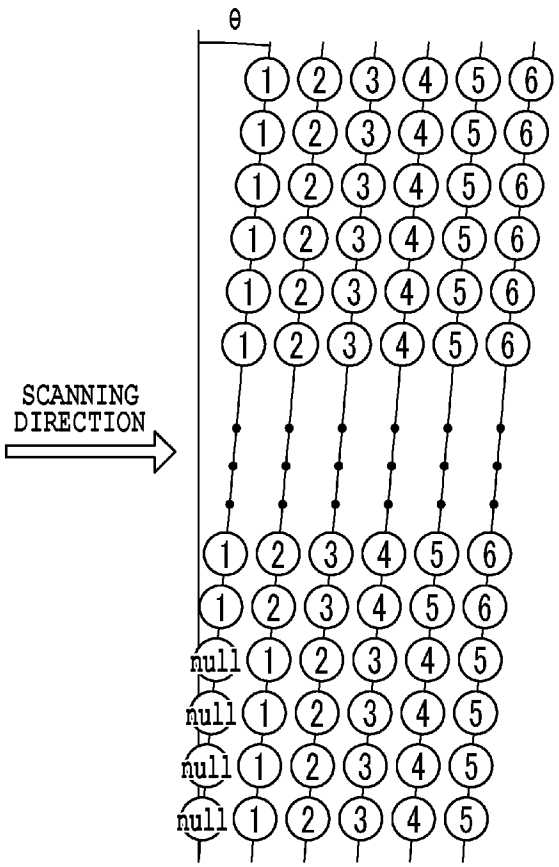

FIGS. 12A to 12C are schematic views showing printing positions on the print medium 9 in a case where ink is ejected from the ejection ports based on the corrected print data, and show the case where the print data is read from the second storage unit 107 shown in FIG. 11 and ink is ejected based on the read print data. Circles shown in FIGS. 12A to 12C represent print data. The numbers in the circles correspond to the column numbers in the first storage unit 101, and the print data to which the same number is given represents data that has been stored in the areas with the same column number in the first storage unit 101. FIGS. 12A to 12C also show an image printed by using one ejection port array. FIGS. 12A to 12C respectively show a case where the print data corresponding to one column is printed, a case where the print data corresponding to two columns is printed, and a case where the print data corresponding to six columns is printed.

If print data is read from the column number 1 in the second storage unit 107 to which the print data is written by the method described with reference to FIG. 11 and ink is ejected from the ejection ports based on the read print data, ink is applied to the print medium 9 as shown in FIG. 12A. Next, if print data is read from the column number 2 in the second storage unit 107 and ink is ejected from the ejection ports based on the read print data, ink is ejected to the print medium 9 as shown in FIG. 12B. If print data is read from the column number 6 in the second storage unit 107 by repeating the same process and ink is ejected based on the read print data, ink is ejected to the print medium 9 as shown in FIG. 12C. In this example, even in a case where the print head is mounted in a manner inclined relative to the attachment reference position, ink is ejected as shown in FIGS. 12A to 12C, so that printing position displacement caused by the inclination can be reduced.

Figure 13:
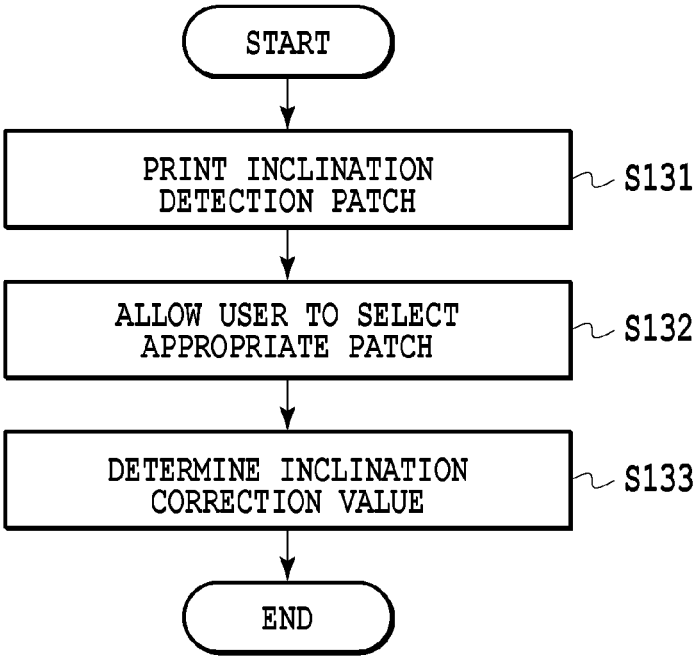
FIG. 13 is a flow chart showing a flow of a process of determining an inclination correction value.

FIG. 13 is a flow chart showing a flow of a process of determining an inclination correction value for correcting printing position displacement caused by inclination of the print head. In the present embodiment, a plurality of patches are printed by using different correction values, and a user is allowed to select, from the plurality of patches, a patch in which printing position displacement is reduced at a largest level. A correction value used for printing the selected patch is used as an inclination correction value.

By an instruction from a user or at a predetermined timing, ink is ejected from the print head by control of the CPU 109, and the plurality of patches for detecting inclination of the print head are printed (S131). In this example, a plurality of patches having different correction values depending on row numbers and different combinations thereof are printed. From the plurality of patches printed on the print medium, the user selects a patch in which printing position displacement is reduced at a largest level (S132). The printing apparatus 1 is provided with an operation panel (not shown) as a user interface, and if one of the patches is selected by the user operating a screen displayed on the operation panel, the information is inputted to the CPU 109. The CPU 109 determines a correction value used for printing the patch selected by the user as an inclination correction value (S133). The inclination correction value is determined through the above-described process. More specifically, the CPU 109 determines an inclination correction value for each row number in the first storage unit 101. The print data stored in each row in the first storage unit 101 is written to the second storage unit 107 according to the inclination correction value assigned to each row number. As shown in FIGS. 17A to 17D which will be described later, in the following description, it is assumed that the row numbers 1, 2, 3, 319, and 320 are determined to have inclination correction values of "6," "5," "4," "1," and "0," respectively. Therefore, in this example, the maximum value of the inclination correction value is "6."

Figure 14:
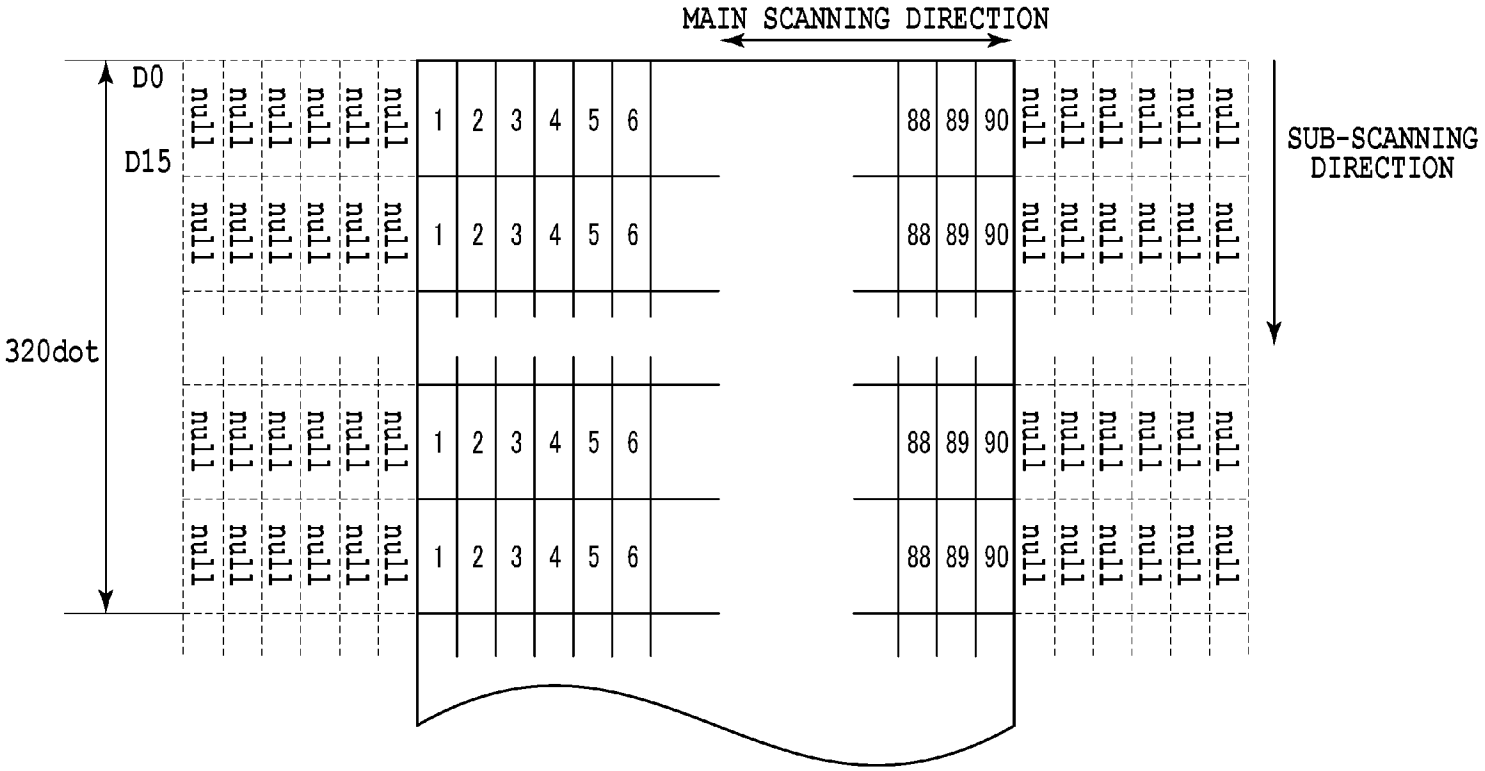
FIG. 14 is a view illustrating print data stored in the first storage unit.

FIG. 14 is a view illustrating print data stored in the first storage unit 101. In FIG. 14, like FIG. 3, the storage format of the print data assigned to an ejection port array is represented as an image on the print medium. FIG. 14 also shows print data in a case where print data is corrected by using the inclination correction value determined by the process described in FIG. 11. In comparison of FIG. 14 with FIG. 7, in FIG. 14, to both the left side of the print data in the first column and the right side of the print data in the 90th column, null data corresponding to the same number of columns as the maximum value "6" of the inclination correction value, that is, six columns, is given. The null data, which is data irrelevant to printing of an image, is added to the right and left sides of the print data by the same number of columns as the maximum value of the inclination correction value, and the null data is handled also as print data to be read. In this example, the data corresponding to 102 columns in total, including the print data corresponding to 90 columns in the main scanning direction and the null data corresponding to six columns added to both the right and left sides of the print data, is stored in the first storage unit 101, and the data is read by the reading unit 104.

Figure 15:
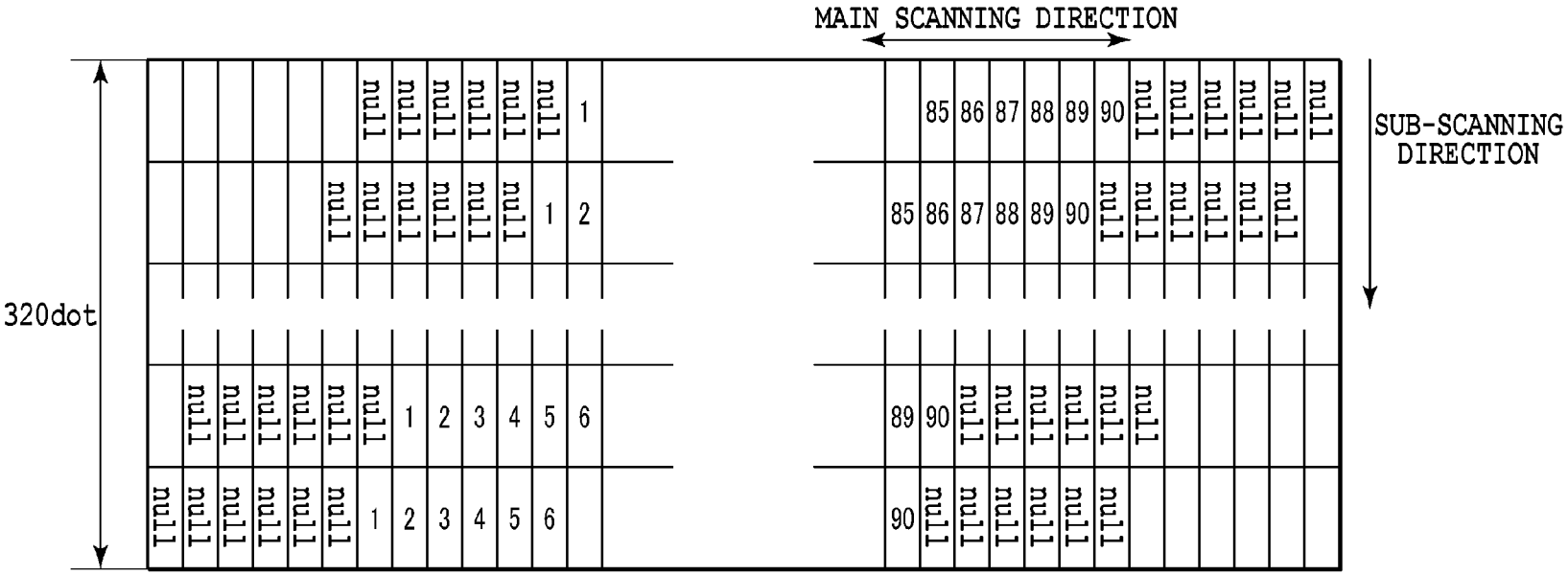
FIG. 15 is a view illustrating print data stored in the second storage unit.

FIG. 15 is a view illustrating print data stored in the second storage unit 107. In this example, a memory having a smaller capacity than the first storage unit 101 is used as the second storage unit 107. More specifically, as the second storage unit 107 as shown in FIGS. 17A to 17D, which will be described later, a memory having a capacity that can store the print data corresponding to eight columns is used. Accordingly, data according to the capacity is successively written to the second storage unit 107, but in FIG. 15, for the convenience of explanation, all the print data stored in the second storage unit 107 is schematically shown. Details will be described later with reference to FIGS. 17A to 17D, but in this example, as shown in FIG. 15, the print data is diagonally stored in the second storage unit 107 so as to correct inclination of the head according to the inclination of the head.

If all the data stored in the second storage unit 107 shown in FIG. 15 is read, data is also read from the columns which include only the null data, so a processing load in reading data increases as compared to the case where only the data for printing an image is read. Further, the processing time increases as compared to the case where only the data for printing an image is read. Accordingly, a printing speed may decrease. Here, in the present embodiment, even in a case where null data is added to correct printing position displacement caused by inclination of the head, the second read permission signal 106 is generated so as not to read the data consisting of only the null data. More specifically, the second read permission signal 106 is generated so as not to read unnecessary null data that is irrelevant to printing of an image. In a case where printing is performed on a predetermined unit area (an area in which the print data corresponding to 90 columns can be printed, in this example) of the print medium, the second read permission signal 106 is generated so that the total amount of data read from the second storage unit 107 is less than the total amount of data read from the first storage unit 101. In the present embodiment, therefore, a timing at which reading of the first read permission signal 103 and the second read permission signal 106 is started, a timing of the end of the reading, and a length of the reading period are different. Details will be described later with reference to FIG. 16 and FIGS. 17A to 17D.

Figure 16:
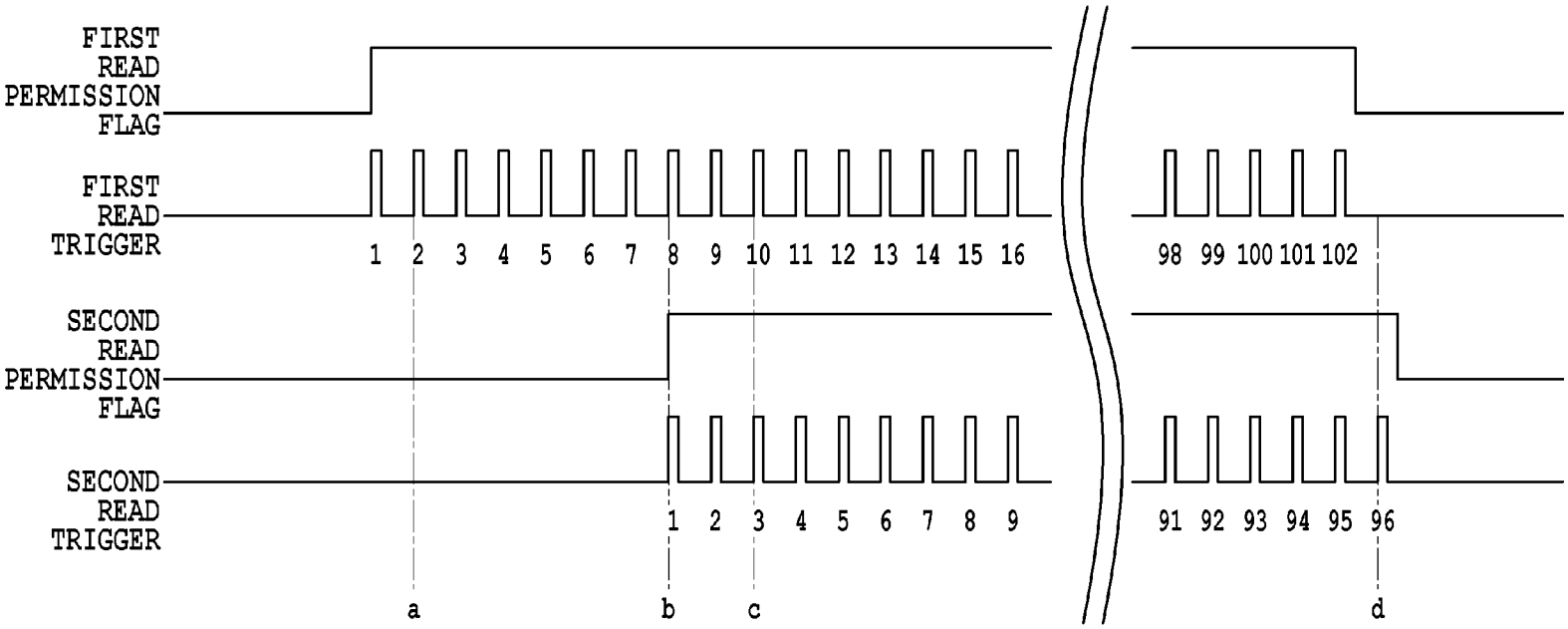
FIG. 16 is a view showing the first read permission signal and the second read permission signal.

FIG. 16 is a view showing the first read permission signal 103 and the second read permission signal 106 and illustrating a temporal relation between the two signals. As shown in FIG. 16, the first read permission flag outputs "H" while the first read trigger becomes "H" 102 times so that the reading unit 104 reads data corresponding to 102 columns from the first storage unit 101. A timing at which the second read permission flag becomes "H" and the second read trigger becomes "H" for a first time corresponds to a timing at which the first read trigger becomes "H" for an eighth time. While the second read permission flag outputs "H," the second read trigger becomes "H" 96 times. That is, the writing/reading unit 105 reads the print data corresponding to 96 columns from the second storage unit 107.

In comparison of FIG. 16 with FIG. 8, timings at which the second read permission flag becomes "H" are different. In FIG. 8, the number of times the first read trigger becomes "H" and the number of times the second read trigger becomes "H" are the same, whereas in FIG. 16, the numbers of times are different. More specifically, the first read trigger becomes "H" 102 times and the second read trigger becomes "H" 96 times in FIG. 16, meaning that the number of times the second read trigger becomes "H" is less than the number of times the first read trigger becomes "H." The reason will be described with reference to FIGS. 17A to 17D.

Figure 17A:
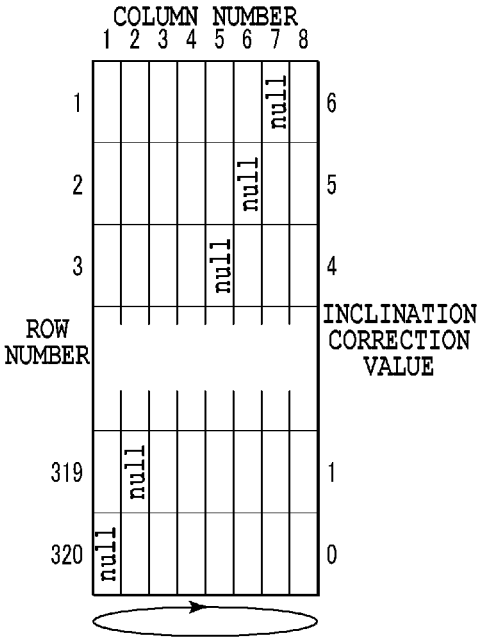
FIGS. 17A to 17D are views showing storage states of the print data in the second storage unit.

FIGS. 17A to 17D are views showing storage states of the print data in the second storage unit 107 at timings a to d shown in FIG. 16. FIG. 17A shows a storage state of the print data in the second storage unit 107 at a timing a, FIG. 17B at a timing b, FIG. 17C at a timing c, and FIG. 17D at a timing d. The numbers shown in the frames in FIGS. 17A to 17D correspond to the numbers shown in the frames shown in FIG. 14. More specifically, the print data stored in the frames to which the same number is given in FIGS. 17A to 17D represents that the print data has been stored in the same column shown in FIG. 14.

As shown in FIG. 17A, at the timing a as shown in FIG. 16, the leftmost null data in the first storage unit 101 shown in FIG. 14 is written to the second storage unit 107. As described above, the data that has been stored in the first storage unit 101 is stored in the area of the column number shifted in the lateral direction by a predetermined amount from the column number 1 according to the inclination correction value assigned to each row. As described above, since the inclination correction value assigned to the row number 1 is "6," the data that has been stored in the row number 1 of the leftmost null data in the first storage unit 101 is written to the area of the column number 7 which is shifted from the column number 1 in the second storage unit 107 by "6" columns. Since the inclination correction value of the row number 320 is "0," the data that has been stored in the row number 320 of the leftmost null data in the first storage unit 101 is written to the area of the column number 1 in the second storage unit 107. Likewise, other data is also written to the second storage unit 107 according to the inclination correction value. It should be noted that also at the timings b to d shown in FIG. 16, each piece of data is stored according to the inclination correction value assigned to each row number.

Figure 17B:
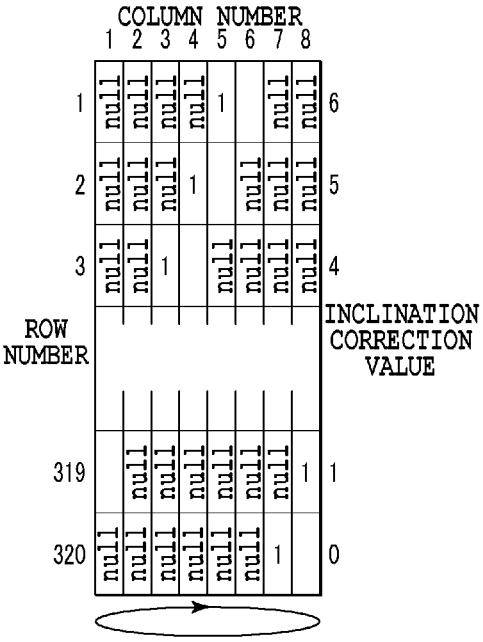

As shown in FIG. 17B, at the timing b shown in FIG. 16, all the null data in the left side and the print data in the first column in the first storage unit 101 are written to the second storage unit 107. As shown in FIG. 16, since the second read trigger becomes "H" for the first time at the timing b, the writing/reading unit 105 reads the print data from the area of the column number 7 in the second storage unit 107 including print data that is not null shown in FIG. 17B.

A description will be given of a column number in the second storage unit 107 from which the writing/reading unit 105 first reads. In the first storage unit 101, in a case where null data corresponding to the same number of columns as the maximum value of the inclination correction value is added to the left side of the first column of the print data, a column number which is offset by the maximum value of the inclination correction value from the column number 1 is first read. Since the maximum value of the inclination correction value is "6" in this example, the column number "7" which is offset from the column number 1 by "6" is first read.

Figure 17C:
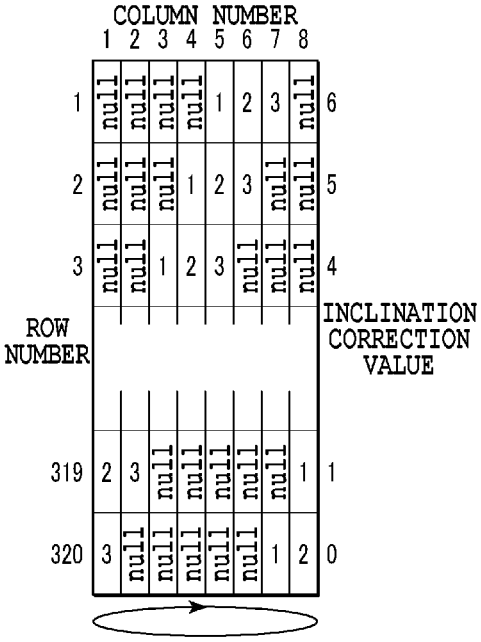

As shown in FIG. 17C, at the timing c shown in FIG. 16, all the null data in the left side and the print data in the first to third columns in the first storage unit 101 are written to the second storage unit 107. In this example, there exist areas in which data is overwritten. The print data has already been read from the area with the column number 7 and the row number 1 of the overwritten areas, so data will not be overwritten before the print data is read. There also exists an area in which null data is overwritten to null data, but the null data is data added to correct inclination, so the null data overwritten to the null data will not affect printing. As shown in FIG. 16, since the second read trigger becomes "H" for a third time at the timing c, reading of the print data of the column number 1 in the second storage unit 107 shown in FIG. 17C is started.

Figure 17D:
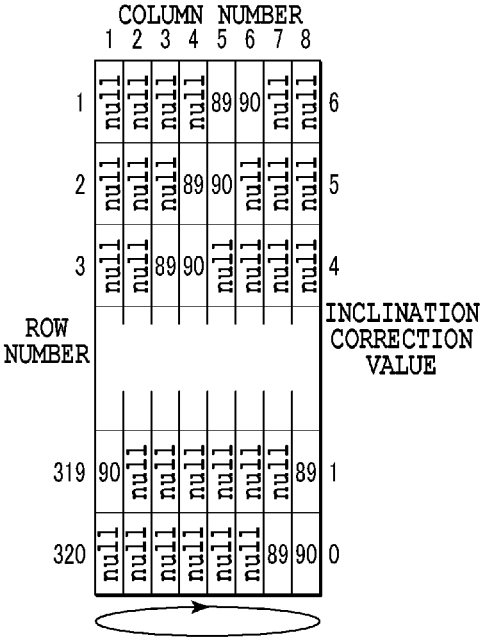

As shown in FIG. 17D, at the timing d shown in FIG. 16, writing to the second storage unit 107 all the data including the null data in the first storage unit 101 has been completed. Therefore, as shown in FIG. 16, at the timing d, the read permission flag becomes "L," entering a state in which reading is not permitted. As shown in FIG. 17D, at the timing d, the print data to the 88th column has already been overwritten, but the writing/reading unit 105 had already read out the stored data before overwriting, so data will not be overwritten before the print data is read. Also, as shown in FIG. 16, since the second read trigger becomes "H" for a 96th time at the timing d, reading of the print data of the column number 6 in the second storage unit 107 shown in FIG. 17D is started.

As shown in FIG. 16, if the second read trigger becomes "H" in the 96th time and the writing/reading unit 105 finishes reading of all the print data used for printing, the second read permission flag becomes entering a state in which reading is not permitted.

In this example, if a maximum value of the inclination correction value is represented by n, when the first read trigger becomes "H" for (2+n)th time, the second read trigger becomes "H" for a first time, and the number of times the second read trigger becomes "H" is set less than the number of times the first read trigger becomes "H" by n times. In other words, in the present embodiment, the number of times the second read trigger becomes "H" is set less than the number of times the first read trigger becomes "H" and the period of the second read trigger being is set shorter than the period of the first read trigger being "H." This allows reading, even in the case where the null data is added to the print data, only the print data used for printing an image in which printing position displacement caused by inclination is reduced from the second storage unit 107 and transferring the data to the print head. That is, it is not needed to read out all the data including the null data stored in the second storage unit 107, and only the data used for printing an image in which printing position displacement is reduced can be transferred to the print head. Therefore, in the present embodiment, it is possible to reduce a processing load and shorten a processing time as compared to the case of reading our all the data.

It should be noted that in the present embodiment, a description has been given of the case where the null data corresponding to the same number of columns as the maximum value of the inclination correction value is added to the right and left sides of the print data, but the number of columns of the null data added to the print data is not limited to this number. An amount of null data added to the print data may be appropriately changed according to an inclination correction value.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)m), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-020417, filed Feb. 4, 2015, which is hereby incorporated by reference wherein in its entirety.

What is claimed is:

1. A data processing apparatus comprising:

a first writing unit configured to write a plurality of printing data arrays corresponding to a print target image to be printed by a print heads having ink ejecting port array into a first storage unit and write a predetermined data arrays representing not printing into area corresponding to outside of the print target image in the first storage unit;

a second writing unit configured to read out data included the plurality of printing data arrays and the predetermined data arrays that have been written into the first storage unit by the first writing unit and write the read out data into a second storage unit with shifting in a direction perpendicular to the arraying direction of the plurality of printing data arrays and the predetermined data arrays according to an inclination of the print head; and a reading unit configured to read out the data that have been written in the second storage unit by the second writing unit, for each data array corresponding to a predetermined ejecting timing of the ink ejecting port array, wherein the reading unit reads out data arrays corresponding to the print target image and does not read out data arrays corresponding to outside of the print target image in the first storage unit, from a plurality data arrays stored in the second storage unit that have been written in by the second writing unit.

2. A data processing apparatus according to claim 1, further comprising:

a generating unit configured to generate a first read permission signal for permitting to read out from the first storage unit and a second read permission signal for permitting to read out from the second storage unit, wherein the second writing unit reads out the data from the first storage unit according to the first read permission signal generated by the generating unit and the reading unit reads out the data from the second storage unit according to the second read permission signal generated by the generating unit, and the generating unit generates the second read permission signal such that a total amount of the data read out from the second storage unit is less than a total amount of the data read out from the first storage unit.

3. A data processing apparatus according to claim 2, wherein the predetermined data arrays includes null data and the generating unit generates the second read permission signal such that an amount of the null data read out from the second storage unit is less than an amount of the null data read out from the first storage unit.

4. A data processing apparatus according to claim 2, wherein the generating unit generates the first read permission signal and the second read permission signal such that a period of permitting to read according to the second read permission signal is shorter than a period of permitting to read according to the first read permission signal.

5. A data processing apparatus according to claim 2, wherein the generating unit generates the first read permission signal and the second read permission signal such that a timing at which reading is permitted by the first read permission signal differs from a timing at which reading is permitted by the second read permission signal.

6. A data processing apparatus according to claim 2, wherein the generating unit generates the first read permission signal and the second read permission signal such that a timing at which reading is not permitted by the first read permission signal is differs from a timing at which reading is not permitted by the second read permission signal.

7. A data processing apparatus according to claim 2, wherein the generating unit generates the first read permission signal and the second read permission signal based on positional information of a carriage mounting the print head thereon.

8. A printing apparatus comprising:

a first writing unit configured to write a plurality of printing data arrays corresponding to a print target image to be printed by a print head having ink ejecting port array into a first storage unit and write a predetermined data arrays representing not printing into area corresponding to outside of the print target image in the first storage unit;

a second writing unit configured to read out data included the plurality of printing data arrays and the predetermined data arrays that have been written into the first storage unit by the first writing unit and write the read out data into a second storage unit with shifting in a direction perpendicular to the arraying direction of the plurality of printing data arrays and the predetermined data arrays according to an inclination of the print head;

a reading unit configured to read out the data that have been written in the second storage unit by the second writing unit, for each data array corresponding to a predetermined ejecting timing of the ink ejecting port array, and a control unit configured to control the print head according to the data that is read out by the reading unit, wherein the reading unit reads out data arrays corresponding to the print target image and does not read out data arrays corresponding to outside of the print target image in the first storage unit, from a plurality data arrays stored in the second storage unit that have been written in by the second writing unit.

9. A printing apparatus according to claim 8, wherein the second writing unit writes the data into the second storage unit so as to compensate the inclination.

10. A printing apparatus according to claim 8, further comprising a determination unit configured to determine an inclination correction value for correcting the inclination, wherein the number of the predetermined data arrays is a number corresponding to the inclination correction value determined by the determination unit.

11. A printing apparatus according to claim 10, wherein the reading unit reads out the data from a position shifted from a predetermined position according to the inclination correction value.

12. A printing apparatus according to claim 8, further comprising:

a generating unit configured to generate a first read permission signal for permitting to read out from the first storage unit and a second read permission signal for permitting to read out from the second storage unit, wherein the second writing unit reads out the data from the first storage unit according to the first read permission signal generated by the generating unit and the reading unit reads out the data from the second storage unit according to the second read permission signal generated by the generating unit, the generating unit generates the second read permission signal such that a total amount of the data read out from the second storage unit is less than a total amount of the data read out from the first storage unit.

13. A printing apparatus according to claim 12, wherein the predetermined data arrays includes null data and the generating unit generates the second read permission signal such that an amount of the null data read out from the second storage unit is less than an amount of the null data read out from the first storage unit.

14. A printing apparatus according to claim 12, wherein the generating unit generates the first read permission signal and the second read permission signal such that a period of permitting to read according to the second read permission signal is shorter than a period of permitting to read according to the first read permission signal.

15. A printing apparatus according to claim 12, wherein the generating unit generates the first read permission signal and the second read permission signal such that a timing at which reading is permitted by the first read permission signal differs from a timing at which reading is permitted by the second read permission signal.

16. A printing apparatus according to claim 12, wherein the generating unit generates the first read permission signal and the second read permission signal such that a timing at which reading is not permitted by the first read permission signal is differs from a timing at which reading is not permitted by the second read permission signal.

17. A printing apparatus according to claim 12, wherein the generating unit generates the first read permission signal and the second read permission signal based on positional information of a carriage mounting the print head thereon.

18. A data processing method comprising:

a first writing step for writing a plurality of printing data arrays corresponding to a print target image to be printed by a print heads having ink ejecting port array into a first storage unit and writing a predetermined data arrays representing not printing into area corresponding to outside of the print target image in the first storage unit;

a second writing step for reading out data included the plurality of printing data arrays and the predetermined data arrays that have been written into the first storage unit by the first writing step and writing the read out data into a second storage unit with shifting in a direction perpendicular to the arraying direction of the plurality of printing data arrays and the predetermined data arrays according to an inclination of the print head; and a reading step for reading out the data that have been written in the second storage unit by the second writing step, for each data array corresponding to a predetermined ejecting timing of the ink ejecting port array, wherein the reading step reads out data arrays corresponding to the print target image and does not read out data arrays corresponding to outside of the print target image in the first storage unit, from a plurality data arrays stored in the second storage unit that have been written in by the second writing step.

* * * * *